United States Patent [19]

Dubost et al.

[11] Patent Number: 4,865,665

[45] Date of Patent: Sep. 12, 1989

[54] METAL ALLOY WITH LARGE LATTICE SPACING

[75] Inventors: Bruno Dubost, Saint-Egrève; Marc Audier, Grenoble, both of France

[73] Assignee: Pechiney, Paris, France

[21] Appl. No.: 200,895

[22] Filed: Jun. 1, 1988

[30] Foreign Application Priority Data

Jun. 5, 1987 [FR] France ..... 87 08304

[51] Int. Cl.[4] ..... C22C 21/00

[52] U.S. Cl. ..... 148/404; 148/432; 148/434; 148/436; 148/437; 148/438; 148/439; 148/440; 148/441; 148/442

[58] Field of Search ..... 420/528, 529, 531, 540; 148/400, 404, 432, 434, 436, 437–440, 441, 442

[56] References Cited

U.S. PATENT DOCUMENTS 4,806,307 2/1989 Hirose et al. ..... 420/528

*Primary Examiner*—R. Dean

*Attorney, Agent, or Firm*—Dennison, Meserole, Pollack & Scheiner

[57] ABSTRACT

The invention concerns a metal alloy with large lattice spacings (>than 1 nm), and consisting essentially of, by weight: at least one element selected from a group A consisting of Al, Zn and Cu, total group A elements being 44–92%; at least one element selected from a group B consisting of Ag, Ga and Au, total group B elements being 0–46%, with % group A+group B=88–92%, and $$\frac{\%\ \text{group A}}{\%\ \text{group A} + \%\ \text{group B}} \geqq 50\%;$$

a group C element which is Li in an amount of 7.2–12%; at least one element selected from a group D consisting of Mg, K, Na, and Ca, total group D elements being 0–12%, with % group C+% group D=8–12%, $$\frac{\%\ \text{group C}}{\%\ \text{group C} + \%\ \text{group D}} \geqq 90\%,$$

and % group A+% group B+% group C+% group D=100%; said alloy additionally comprising elemental impurities in an amount of less than 1% each and less than 5% total, based on the total weight of the alloy.

7 Claims, 1 Drawing Sheet

METAL ALLOY WITH LARGE LATTICE SPACING

Figure 1:
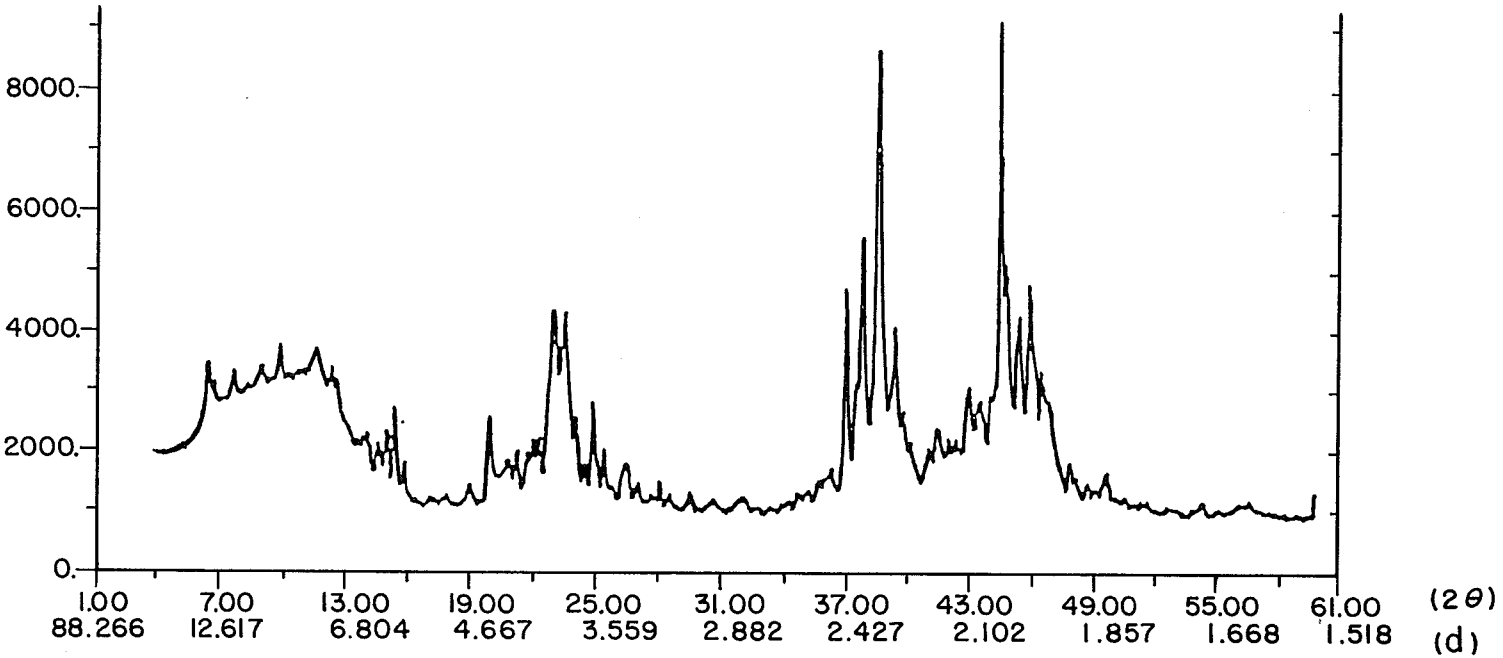

The invention concerns metal alloys characterized by a large lattice spacing (>1 nm).

Diffraction or refluxion of radiation of a wavelength of approximately 1 nm (10 A), that is to say, soft X-rays or very slow neutrons, requires crystalline substances with a high lattice spacing generally over 1 nm. These lattice sizes are generally reached only in organic crystals or pseudo-crystals. Table I gives the composition of some of these substances together with the corresponding lattice spacings (d) and the elements which can be analysed by X-ray fluorescence or spectral dispersion microanalysis (on the K radiation). Now these pseudo-crystals are not very stable in time ageing), so it was important to obtain crystallised metallic alloys with large lattice spacings; monochromators made of organic crystals (or pseudo-crystals) are as a matter of fact known to have weak reflecting power and poor resolution. In working on quasi-crystals, Applicants have found that the problem is solved by metallic crystals of a composition represented by the weight formula $$(Al, Zn, Cu)_x Li_{1-x} \text{ with } 0.88 \leqq x \leqq 0.92,$$

where the group Al, Zn, Cu may be partially substituted up to a total of 50% by weight by Ag, Ga and/or Au, and where the Li may be partially substituted by one or more elements of the group Mg, Na, K, Ca up to a total of 10% by weight, the other elements (impurities) being kept at < than 1% each and less than 5% altogether.

Within the field defined above the compositions are preferably as follows (% by weight):

$60 \leqq Al \leqq 65$ $20 \leqq Zn \leqq 32$ $0 \leqq Cu \leqq 6$ $9 \leqq Li \leqq 11.$ The following is a preferred composition:

Al=62%

Cu=4%

Li=10%

Zn=24%.

The above elements may be replaced by one or more of their isotopes to improve their neutron diffusion factor.

Monocrystals of such alloys may be obtained by a known method of preparing monocrystals, such as the Bridgeman or Czochralski method, with (or without) the use of nuclei and controlled temperature gradients. They are preferably produced by the method described in French Patent Application No. 86-15774. It is preferable for them to be annealed at from 300° to 500° C. for a period of from some hours to some tens of hours, in order to obtain a homogeneous structure and finer diffraction lines.

The invention will be further explained by the following examples. They are illustrated by FIG. 1, which is an X-ray diffraction graph corresponding to Example 1 with small diffraction angles.

EXAMPLE 1

An alloy made up of Al-19% Zn-4.5% Cu and 7.5% Li is cast in ingots at from 750° C. in an inert atmosphere, with a slow solidification period of approximately one hour at from 620° C. to 560° C.

After complete cooling monocrystals some centimeters in size are found in the contraction cavity in the solidified material; the monocrystals are of columnar growth, in the form of square based pyramids with the direction of growth corresponding exactly to the C axis of the quadratic structure. Study of ground samples by X-ray diffraction reveals a quite exceptional number of diffraction lines (Debye and Scherrer method) detectable on a diffractometer (see FIG. 1), due to the structure with a very large lattice parameter (a ≃1.4 nm, c ≃8.2 nm). The structure obtained is checked by electronic microdiffraction on thin plates. Analysis of the solid monocrystals by atomic absorption gives the following:

Li=10%

Cu=4.1%

Zn=24% remainder Al corresponding to the atomic formula: $Al_{5,5}Cu_{1,5}Zn_{8,5}Li_{35}$. The lattice spacings measured and the Miller indices of the atomic planes are shown in Table II.

EXAMPLE 2

Ingots 18 mm in diameter are cast, made of alloys according to the invention (% by weight):

10.2 Li-30 Zn-remainder Al

41 Cu-10.5 Li-24 Zn-remainder Al 9.5 Li-1.5 Mg-28 Zn-remainder Al 3.7 Cu-23 Zn-9 Li-1.5 Mg-remainder Al 3.6 Cu-22 Zn-2% Ag-9.8 Li-0.5 Mg, remainder Al.

These are annealed for 72 hours at 400° C.+72 hours at 500° C. Under these conditions alloys within the scope of the invention are found to have a very large fraction by volume (over 80%) of large, quadratic phase crystals embedded in eutectic.

Annealing has the effect of completely resorbing most of the primary phases such as δ-Al Li or of the constituents of the eutectic $Al_2LiMg$. The above ground alloys can provide an internal standard for X-ray crystallography.

Alloys according to the invention can thus be used as internal standards for X-ray crystallography (powder-diagrams) or as monochromators of great reflective power and good resolution in analytical methods using spectral dispersion of soft X-rays or slow neutrons.

TABLE 1

| | Type | | 2d nm (Å) | Analytical field (K radiation) |
|---|---|---|---|---|
| Prior art | Acid potassium phthalate | | 2.6632 (26.632) | F—P |
| | Acid thallium phthalate | | 2.570 (25.70) | F—P |
| | Lead laurate* | | 7.—(70) | C—F |
| | Lead myristate* | | 8.—(80) | B—F |
| | Lead stearate* | | 10.—(100) | B—O |
| | Lead lignocerate* | | 13.—(130) | B—O |
| | Lead cerotate* | | 14.4 (144) | B—N |
| | Lead melissate* | | 16.—(160) | Be—C |
| According to the invention | Alloy Al—Li—Cu—Zn (see Example 1). | Quadratic | a = 1.39 (13.9) c = 8.2 (82) | B—F |

*Pseudocrystals (smectic structure)

TABLE II

X-ray crystallography data for tetragonal phase a: 13.91 A, c: 82.05 A

| | | | | | | | | | | | |
|---|---|---|---|---|---|---|---|---|---|---|---|
| h.k.l | 0.1.1 | 0.1.2 | 0.0.7 | 0.1.4 | 1.1.0 | 0.1.7 | 0.1.9 | 1.1.7 | 1.1.8 | 0.2.0 | 1.1.9 |
| d measured (A) | 13,753 | 13,182 | 11,602 | | 9,88 | 8,923 | 7,582 | | 7,126 | 6,99 | 6,661 |
| d calculated (A) | 13,718 | 3,177 | 11,722 | 11,515 | 9,84 | 8,965 | 7,626 | 7,356 | 7,100 | 6,957 | 6,687 |
| h.k.l | 1.2.0 | 1.2.3 | 0.0.14 | 1.2.6 | 0.2.9 | 1.2.7 | 2.2.1 | 0.3.0 | 1.2.13 | 1.3.0 | 1.3.5 |
| d measured (A) | 6,245 | 6,011 | 5,84 | 5,693 | 5,518 | | 4,904 | 4,635 | 4,416 | | 4,242 |
| d calculated (A) | 6,223 | 6,067 | 5,86 | 5,664 | 5,531 | 5,496 | 4,911 | 4,638 | 4,431 | 4,400 | 4,25 |
| h.k.l | 0.3.8 | 1.3.6 | 1.1.18 | 0.3.9 | 1.3.8 | 0.3.10 | 1.3.9 | 0.0.21 | 2.2.13 | 2.3.0 | 2.3.1 |
| d measured (A) | | 4,15 | | | 4,061 | 4,009 | 3,962 | 3,890 | | 3,855 | |
| d calculated (A) | 4,226 | 4,189 | 4,136 | 4,134 | 4,044 | 4,038 | 3,963 | 3,907 | 3,88 | 3,859 | 3,855 |
| h.k.l | 2.3.2 | 1.1.20 | 2.2.14 | 2.3.5 | 0.3.13 | 0.0.22 | 1.3.12 | 1.2.18 | 1.1.21 | 2.3.8 | 0.1.22 |
| d measured (A) | | 3,771 | | 3,735 | | | 3,687 | | 3,626 | | 3,571 |
| d calculated (A) | 3,842 | 3,787 | 3,768 | 3,757 | 3,737 | 3,730 | 3,700 | 3,677 | 3,631 | 3,612 | 3,603 |

What is claimed is:

1. A metal alloy with large lattice spacing greater than 1 nm, consisting essentially of, by weight:

at least one element selected from a group A consisting of Al, Zn and Cu, total group A elements being 44–92%;

at least one element selected from a group B consisting of Ag, Ga and Au, total group B elements being 0–46%, with % group A+% group B=88–92%, and $$\frac{\%\ \text{group A}}{\%\ \text{group A} + \%\ \text{group B}} \geqq 50\%;$$

a group C element which is Li in an amount of 7.2–12%;

at least one element selected from a group D consisting of Mg, K, Na, and Ca, total group D elements being 0–12%, with % group C+% group D=8–12%, $$\frac{\%\ \text{group C}}{\%\ \text{group C} + \%\ \text{group D}} \geqq 90\%,$$

and % group A+% group B+% group C=% group D=100%;

said alloy additionally comprising elemental impurities in an amount of less than 1% each and less than 5% total, based on the total weight of the alloy.

2. The alloy of claim 1, consisting essentially of (in % by weight):

$60 \leqq Al \leqq 65$ $20 \leqq Zn \leqq 32$ $0.5 \leqq Cu \leqq 6$ $9 \leqq Li \leqq 11.$ 3. The alloy of claim 2, consisting essentially of:

Zn=24%

Li=10%

Cu=4% remainder Al.

4. The alloy of claim 1, 2, or 3 comprising a tetragonal phase with parameters approximately a=1.4 nm and c=8.2 nm.

5. The alloy of claim 1, 2 or 3 which is aluminum based.

6. A monochromator comprising a monocrystal of an alloy according to claim 1, 2 or 3.

7. An internal standard for X-ray crystallography comprising a powder of an alloy according to claim 1, 2 or 3.

* * * * *